US006079846A

United States Patent [19]

Huang

[11] Patent Number: 6,079,846

[45] Date of Patent: Jun. 27, 2000

[54] SOCKET HAVING A LIGHT DEVICE

[76] Inventor: Yung Hsu Huang, No. 10, Lane 38, Li Der Street, Taiping City, Taichung Hsien, Taiwan

[21] Appl. No.: 09/131,682

[22] Filed: Aug. 10, 1998

[51] Int. Cl.[7] ..... B25B 23/18

[52] U.S. Cl. ..... 362/119; 362/120; 362/109

[58] Field of Search ..... 362/109, 119, 362/120, 253; 81/121.1, 124.3, 124.6; 403/299, 300, 341

[56] References Cited

U.S. PATENT DOCUMENTS 47,031 3/1865 Moore ..... 403/341

5,477,434 12/1995 Reed ..... 362/119

*Primary Examiner*—Sandra O'Shea
*Assistant Examiner*—John A. Ward
*Attorney, Agent, or Firm*—Charles E. Baxley, Esq.

[57] ABSTRACT

A socket includes a barrel having a stem and one or more openings formed in one end. A cap is secured to the barrel and has an orifice for engaging with a driving tool and for allowing the cap and the barrel to be driven by the driving tool. A light device is received in the barrel and has a switch extendible outward through the orifice of the cap for allowing the switch to be depressed by the driving tool when the driving tool is engaged into the orifice of the cap and for allowing the light device to be energized and controlled by the driving tool.

4 Claims, 4 Drawing Sheets

SOCKET HAVING A LIGHT DEVICE

BACKGROUND OF THE INVENTION

1. Field of the Invention

The present invention relates to a socket, and more particularly to a socket having a light device.

2. Description of the Prior Art

Typical sockets are provided for coupling a fastener to a driving tool, such as a wrench, and for allowing the fastener to be driven by the driving tool. The sockets have no space for receiving light devices.

The present invention has arisen to mitigate and/or obviate the afore-described disadvantages of the conventional sockets.

SUMMARY OF THE INVENTION

The primary objective of the present invention is to provide a socket having a light device for illumination purposes.

In accordance with one aspect of the invention, there is provided a socket comprising a barrel including a first end having a stem formed thereon and having at least one opening formed therein, the barrel including a chamber formed therein, a cap including an orifice for engaging with a driving tool and for allowing the cap to be driven by the driving tool, a light device received in the chamber of the barrel and including a switch extendible outward through the orifice of the cap for allowing the switch to be depressed by the driving tool when the driving tool is engaged into the orifice of the cap, and means for securing the cap to the barrel, the barrel being rotated in concert with the cap. The light device is energized when the switch of the light device is depressed by the driving tool and the light generated by the light device may emit through the at least one opening of the barrel.

The barrel includes a second end having a stud of non-circular cross section formed thereon, the cap includes a recess of non-circular cross section formed therein for receiving the stud of the barrel and for allowing the barrel and the cap to be rotated in concert with each other.

The cap and the barrel each includes an outer thread, the securing means includes a locking ring having an inner thread for threadedly engaging with the outer threads of the barrel and the cap and for securing the cap to the barrel.

The stem of the barrel includes at least one aperture formed therein and communicating with the chamber of the barrel for allowing the light generated by the light device to be emitted through the at least one opening of the barrel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
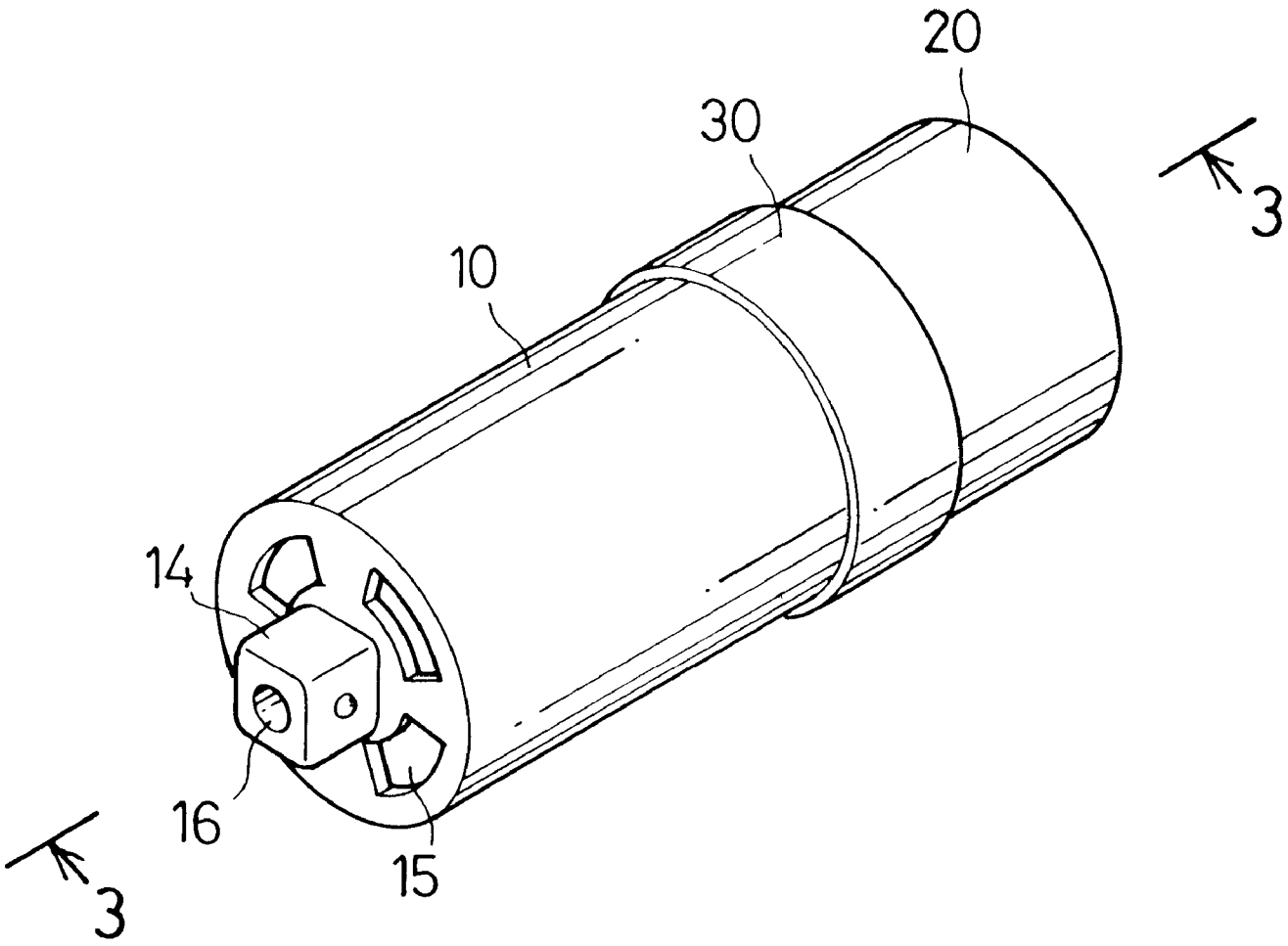
FIG. 1 is a perspective view of a socket in accordance with the present invention.
Figure 2:
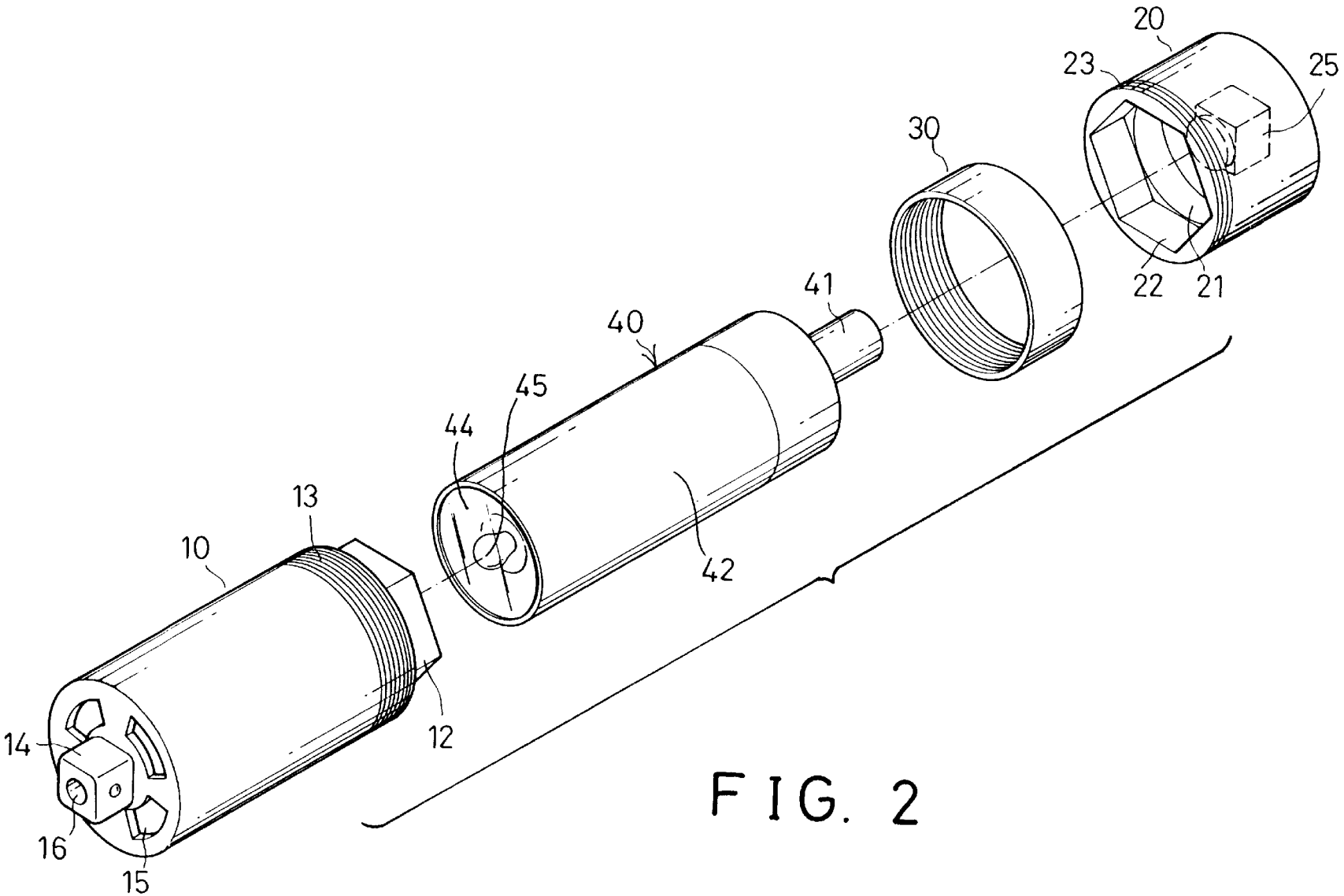
FIG. 2 is an exploded view of the socket.
Figure 3:
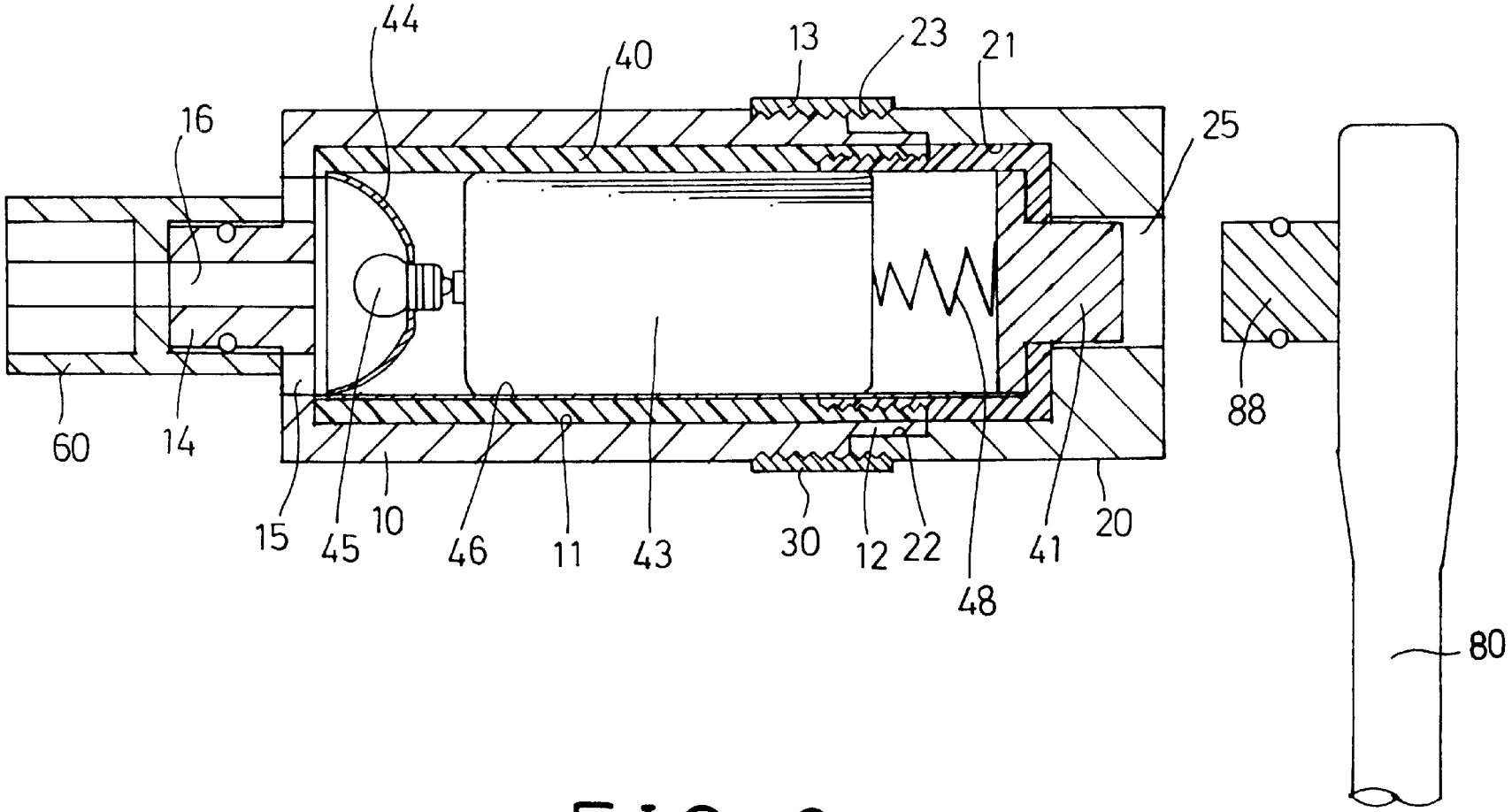
FIG. 3 is a cross sectional view taken along lines 3—3 of FIG. 1.

Referring to the drawings, and initially to FIGS. 1–3, a socket in accordance with the present invention comprises a barrel 10 having a chamber 11 formed therein for receiving a light device 40. The barrel 10 includes a stem 14 extended from one end for engaging with the fastener, or the tool extension, or the other socket and includes one or more openings 15 formed in the one end and communicating with the chamber 11 of the barrel 10. The stem 14 may also include one or more apertures 16 formed therein and communicating with the chamber 11 of the barrel 10. The barrel 10 includes a stud 12 provided on the other end and having a non-circular cross section, and includes an outer thread 13 formed on the other end for threadedly engaging with an inner thread of a locking ring 30. A cap 20 has a recess 22 of non-circular cross section for engaging with the stud 12 of the barrel 10 and for allowing the barrel 10 and the cap 20 to be rotated in concert with each other. The cap 20 includes a depression 21 for receiving the housing 42 of the light device 40, and includes an outer thread 23 for engaging with the locking ring 30 and for solidly securing to the barrel 10. The cap 20 includes an orifice 25 communicating with the depression 21 for receiving the driving stem 88 of a driving tool 80 and for allowing the barrel 10 and the cap 20 to be rotated by the driving tool 80.

The light device 40 includes a housing 42 for receiving one or more batteries 43 and having a reflector 44 and a light bulb 45 secured in one end. The light bulb 45 is electrically coupled to the center electrode of the batteries 43. A conductor 46 is secured in the housing 42 and has one end electrically coupled to the light bulb 45 via the reflector 44 or directly coupled to the light bulb 45. A switch 41 is slidably received in the other end of the housing 42 and adapted to be engaged with the other end of the conductor 46. A spring 48 is biased between the switch 41 and the case electrode of the batteries 43, for disengaging the switch 41 from the conductor 46 and for moving the switch 41 outward through the orifice 25 of the cap 20.

Figure 4:
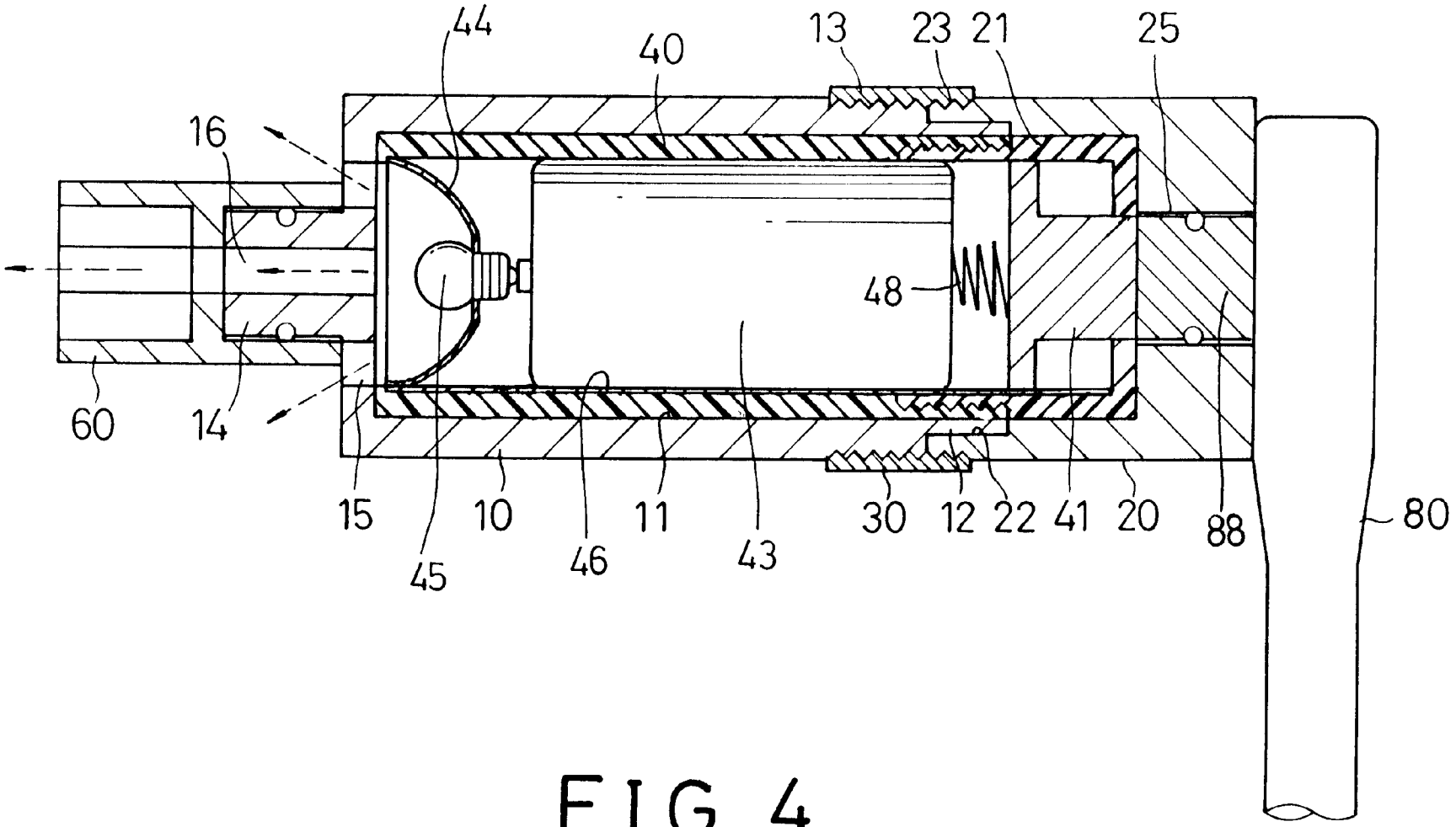
FIG. 4 is a cross sectional view similar to FIG. 3, illustrating the operation of the socket.

In operation, as shown in FIG. 4, when the driving stem 88 of the driving tool 80 is engaged into the orifice 25 of the cap 20, the switch 41 may be forced inward of the cap 20 against the spring 48 and may be caused to engage with the conductor 46, such that the light bulb 45 may be energized by the batteries 43. The light generated by the light bulb 45 may be emitted through the the openings 15 and/or the aperture 16 for lighting purposes. The light device 40 may be any typical flashlight that has a switch button provided in one end.

Accordingly, the socket in accordance with the present invention includes a light device for illumination purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A socket comprising:

a barrel including a chamber formed therein and including a first end having at least one opening formed therein and communicating with said chamber of said barrel, said first end of said barrel including a stem extended therefrom, a cap including an orifice for engaging with a driving tool and for allowing said cap to be driven by the driving tool, a light device received in said chamber of said barrel and including a switch extendible outward through said orifice of said cap for allowing said switch to be depressed by the driving tool when the driving tool is engaged into said orifice of said cap, and means for securing said cap to said barrel, said barrel being rotated in concert with said cap, said light device being energized when said switch of said light device is depressed by the driving tool and a light generated by said light device may emit through said at least one opening of said barrel.

2. The socket according to claim 1, wherein said barrel includes a second end having a stud of non-circular cross section formed thereon, said cap includes a recess of non-circular cross section formed therein for receiving said stud of said barrel and for allowing said barrel and said cap to be rotated in concert with each other.

3. The socket according to claim 1, wherein said cap and said barrel each includes an outer thread, said securing means includes a locking ring having an inner thread for threadedly engaging with said outer threads of said barrel and said cap and for securing said cap to said barrel.

4. The socket according to claim 1, wherein said stem of said barrel includes at least one aperture formed therein and communicating with said chamber of said barrel for allowing said light generated by said light device to be emitted through said at least one opening of said barrel.

* * * * *